US005600199A

United States Patent [19]

Martin, Sr. et al.

[11] Patent Number: 5,600,199

[45] Date of Patent: Feb. 4, 1997

[54] FLUORESCENT LAMP WITH SPRING-LOADED TERMINAL PINS

[76] Inventors: Steve E. Martin, Sr., 22 First Rd., Marlborough, Mass. 01752; Kevin M. Kelly, 59A Second St., Framingham, Mass. 01701

[21] Appl. No.: 306,398

[22] Filed: Sep. 15, 1994

[51] Int. Cl.[6] ..... H01J 5/50; H01R 13/24

[52] U.S. Cl. ..... 313/318.02; 313/318.05; 439/602; 439/613; 439/617; 439/234; 439/244; 439/700; 439/824

[58] Field of Search ..... 313/491, 574, 313/567, 577, 583, 623, 626, 631, 292, 318.01, 318.02, 318.05, 51, 318.03; 439/337, 338, 546, 602, 605, 611, 612, 613, 617, 232, 239, 241, 244, 234, 824, 700

[56] References Cited

U.S. PATENT DOCUMENTS

| | | | |
|---|---|---|---|
| 3,582,866 | 6/1971 | Johnson et al. | 439/225 |
| 3,784,867 | 1/1974 | Dupree | 313/318.05 |
| 4,050,762 | 9/1977 | Hines et al. | 439/824 |
| 4,102,558 | 7/1978 | Krachman | 313/318.02 X |
| 4,506,192 | 3/1985 | Koenigsberg et al. | 313/51 X |
| 4,878,854 | 11/1989 | Cannon | 313/318.02 X |
| 5,013,962 | 5/1991 | Desclos | 439/612 |
| 5,169,331 | 12/1992 | Caldwell et al. | 439/239 |
| 5,261,831 | 11/1993 | Vendal et al. | 439/232 |

FOREIGN PATENT DOCUMENTS

| | | | |
|---|---|---|---|
| 0816229 | 7/1959 | United Kingdom | 313/318.05 |

*Primary Examiner*—Sandra L. O'Shea
*Assistant Examiner*—Ashok Patel
*Attorney, Agent, or Firm*—Steven N. Fox, Esq.

[57] ABSTRACT

A fluorescent lamp with spring-loaded terminal pins includes a tube having an inner surface and an outer surface; an amount of electrically excitable gas disposed in the tube; a fluorescent chemical coat disposed on the inner surface of the tube; a pair of electrodes with each electrode positioned within the tube near each end thereof; a pair of base caps each sealed to a separate end of the tube such that the length of the tube including base caps is about four feet; and a pair of spring-loaded terminal pins extended through each base cap and coupled to the nearest electrode for delivering electrical energy thereto.

1 Claim, 4 Drawing Sheets

FLUORESCENT LAMP WITH SPRING-LOADED TERMINAL PINS

BACKGROUND OF THE INVENTION

1. Field of the Invention

The present invention relates to a fluorescent lamp with spring-loaded terminal pins and more particularly pertains to allowing ready installation of a fluorescent lamp in a fluorescent luminaire for illuminating an area with a fluorescent lamp with spring-loaded terminal pins.

2. Description of the Prior Art

The use of fluorescent lamps with fixed terminal pins is known in the prior art. More specifically, fluorescent lamps with fixed terminal pins heretofore devised and utilized for the purpose of installation in a fluorescent luminaire are known to consist basically of familiar, expected and obvious structural configurations, notwithstanding the myriad of designs encompassed by the crowded prior art which have been developed for the fulfillment of countless objectives and requirements.

By way of example, U.S. Design Pat. No. 248,593 to Oster discloses a fluorescent light bulb. U.S. Pat. No. 3,582,866 discloses a fluorescent tube conductor. U.S. Pat. No. 4,050,762 to Hines et al. discloses a telescoping spring probe having separate wiper contact member. U.S. Pat. No. 5,169,331 to Caldwell et al. discloses a lampholder lead wire connector. U.S. Pat. No. 5,261,831 to Vendal et al. discloses a fluorescent lamp socket.

While these devices fulfill their respective, particular objective and requirements, the aforementioned patents do not describe a fluorescent lamp with a length of about four feet having spring-loaded terminal pins that allow its ready installation into a luminaire thereby precluding damage to the luminaire or to the fluorescent lamp itself.

In this respect, the fluorescent lamp with spring-loaded terminal pins according to the present invention substantially departs from the conventional concepts and designs of the prior art, and in doing so provides an apparatus primarily developed for the purpose of allowing its ready installation in a fluorescent luminaire for illuminating an area.

Therefore, it can be appreciated that there exists a continuing need for new and improved fluorescent lamp with spring-loaded terminal pins which can be used for allowing its ready installation in a fluorescent luminaire for illuminating an area. In this regard, the present invention substantially fulfills this need.

SUMMARY OF THE INVENTION

In the view of the foregoing disadvantages inherent in the known types of fluorescent lamps with fixed terminal pins now present in the prior art, the present invention provides an improved fluorescent lamp with spring-loaded terminal pins. As such, the general purpose of the present invention, which will be described subsequently in greater detail, is to provide a new and improved fluorescent lamp with spring-loaded terminal pins and method which has all the advantages of the prior art and none of the disadvantages.

To attain this, the present invention essentially comprises, in combination, a transparent tube having an inner surface and an outer surface. A small amount of low pressure gas is disposed within the tube wherein the gas is selected from the group consisting of argon, neon, sodium, or mercury. A fluorescent chemical coat is disposed on the inner surface of the tube. A pair of electrodes are included with each electrode positioned within the tube near each end thereof. A pair of base caps are included with each base cap sealed to a separate end of the tube. A pair of terminal pins are included. The terminal pins are extended through each base cap and coupled to the nearest electrode for transferring electrical current from an external power source thereto. Each terminal pin has a compressed orientation and an uncompressed orientation. Each terminal pin includes an elongated inner stem having a proximal end, a distal end, and an intermediate portion therebetween, an axial bore disposed through the distal end and terminated at a location within the intermediate portion, a vent hole disposed through the intermediate portion and in communication with the bore, a first collar formed thereon between the vent hole and proximal end, and a second collar formed thereon between the vent hole and distal end. Each terminal pin includes an elongated outer stem having a proximal end disposed within the bore of the inner stem and a distal end projected therefrom and having a head formed thereon. Each terminal pin includes a spring disposed about the inner stem and outer stem between the second collar and the head. Lastly, each terminal pin includes a sleeve having an open slotted proximal end, an open distal end, and an intermediate portion therebetween, and a vent hole formed through the intermediate portion. The sleeve is disposed about the outer stem, spring, and inner stem such that the proximal end thereof is secured about the inner stem for slidable movement thereon and the open distal end thereof is secured about the outer stem such that the outer stem is retracted towards the inner stem in the compressed orientation and urged away from the inner stem in an uncompressed orientation. The ratio of the length of each terminal pin in an uncompressed orientation to the length of the tube including end caps is between about 0.0051–0.0053. The length of each terminal pin is compressed by about 10% to 50% in the compressed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluorescent lamp with spring-loaded terminal pins which has all the advantages of the prior art fluorescent lamps with fixed terminal pins and none of the disadvantages.

It is another object of the present invention to provide a new and improved fluorescent lamp with spring-loaded terminal pins which may be easily and efficiently manufactured and marketed.

It is a further object of the present invention to provide a new and improved fluorescent lamp with spring-loaded terminal pins which is of durable and reliable construction.

An even further object of the present invention is to provide a new and improved fluorescent lamp with spring-loaded terminal pins which is susceptible of a low cost of manufacture with regard to both materials and labor, and which accordingly is then susceptible of low prices of sale to the consuming public, thereby making such a fluorescent lamp with spring-loaded terminal pins economically available to the buying public.

Still yet another object of the present invention is to provide a new and improved fluorescent lamp with spring-loaded terminal pins which provides in the apparatuses and methods of the prior art some of the advantages thereof, while simultaneously overcoming some of the disadvantages normally associated therewith.

Even still another object of the present invention is to provide a new and improved fluorescent lamp with spring-loaded terminal pins for allowing its ready installation in a fluorescent luminaire for illuminating an area.

Lastly, it is an object of the present invention to provide a new and improved fluorescent lamp with spring-loaded terminal pins comprising a tube having an inner surface and an outer surface; an amount of electrically excitable gas disposed in the tube; a fluorescent chemical coat disposed on the inner surface of the tube; a pair of electrodes with each electrode positioned within the tube near each end thereof; a pair of base caps each sealed to a separate end of the tube such that the length of the tube including base caps is about four feet; and a pair of spring-loaded terminal pins extended through each base cap and coupled to the nearest electrode for delivering electrical energy thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
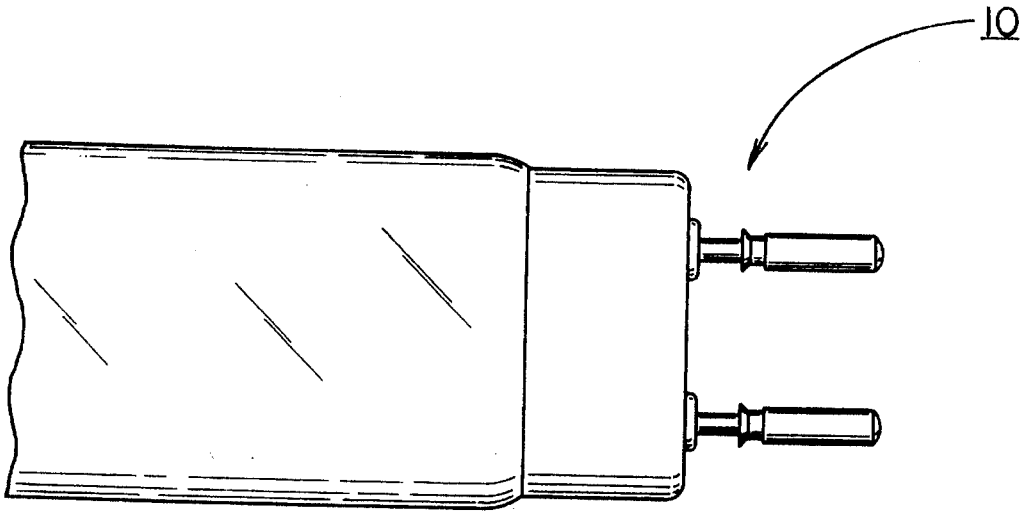
FIG. 1 is a side elevational view of a portion of the preferred embodiment constructed in accordance with the principles of the present invention with the terminal pins in an uncompressed orientation.

With reference now to the drawings, and in particular, to FIG. 1 thereof, the preferred embodiment of the new and improved fluorescent lamp with spring-loaded terminal pins embodying the principles and concepts of the present invention and generally designated by the reference number 10 will be described.

Specifically, the present invention essentially includes two major components. The major components are the lamp portion and terminal pins. These components are interrelated to provide the intended function.

More specifically, it will be noted in the various Figures that the first major component is the lamp portion 12. The lamp portion includes a transparent tube 14 formed of a glass material. The tube has an inner surface and an outer surface. a small amount of low pressure gas such as argon, neon, sodium, or mercury is disposed within the tube. A fluorescent chemical coat or phosphor is disposed on the inner surface of the tube for providing illumination with a selected color. For example, a phosphor such as calcium halophosphate may be used for producing white light or calcium tungstate may be used for producing blue light. The fluorescent chemical coat or phosphor chosen to be disposed on the inner surface on the tube may be selected upon desired efficiency, color-rendering properties, and appearance. The lamp portion also includes a pair of electrodes. Each electrode is positioned within the tube near each end thereof. Each electrode is used to electrically actuate the gas for interaction with the chemical phosphor coat. The lamp portion also includes a pair of base caps 16. Each base cap is rigid in structure and formed of a nonconductive material. Each base cap is sealed to a separate end of the tube for containing the gas therein.

Figure 2:
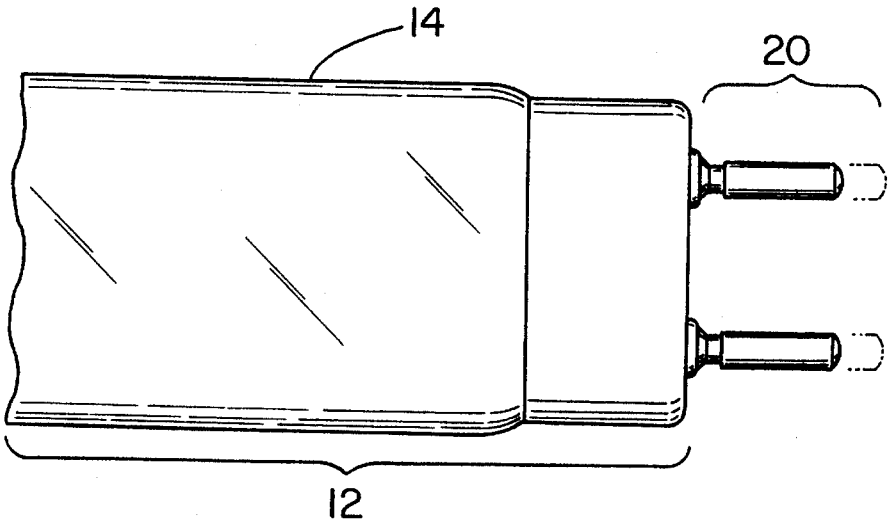
FIG. 2 is yet another side elevational view of the relevant portion of the present invention with the terminal pins in a compressed orientation.
Figure 3:
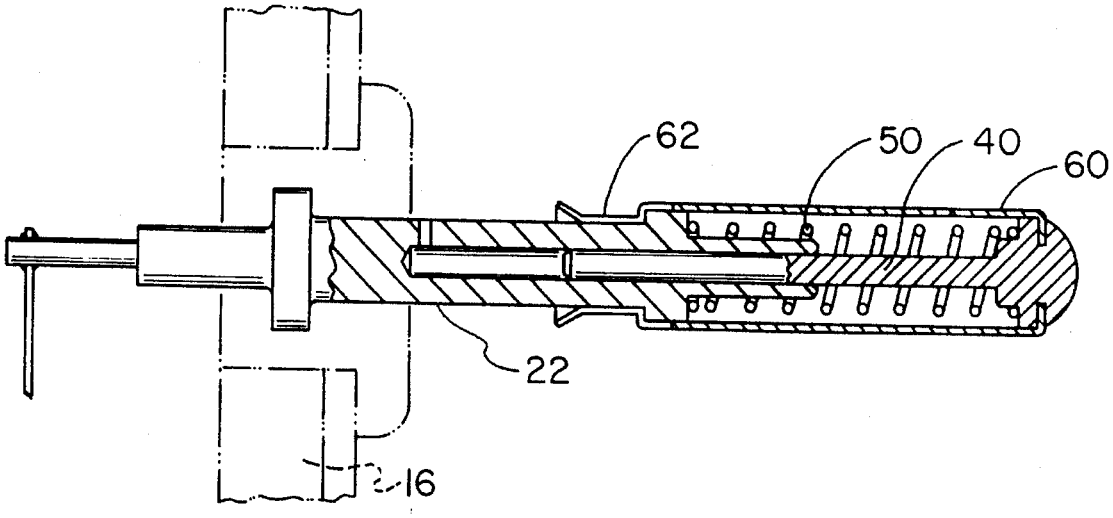
FIG. 3 is a cross-sectional view of a terminal pin of the present invention.
Figure 4:
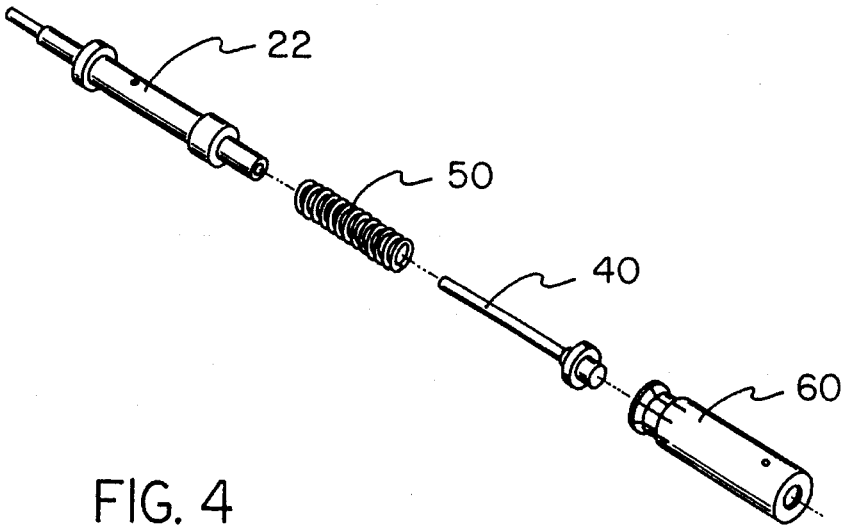
FIG. 4 is an exploded perspective view of a terminal pin of the present invention.
Figure 5:
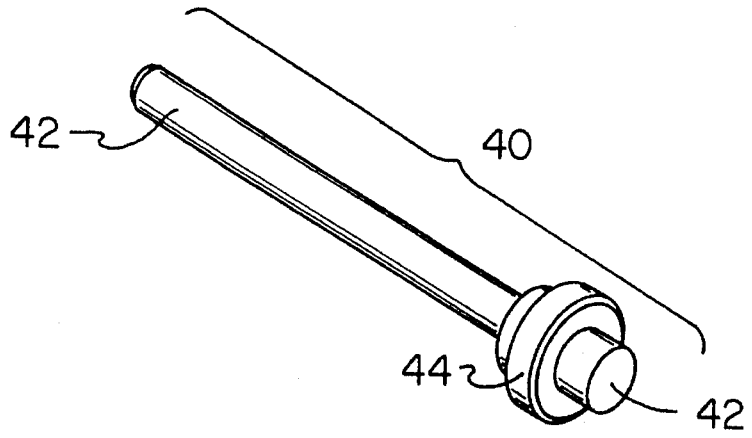
FIG. 5 is a perspective view of the outer stem of a terminal pin of the present invention.
Figure 6:
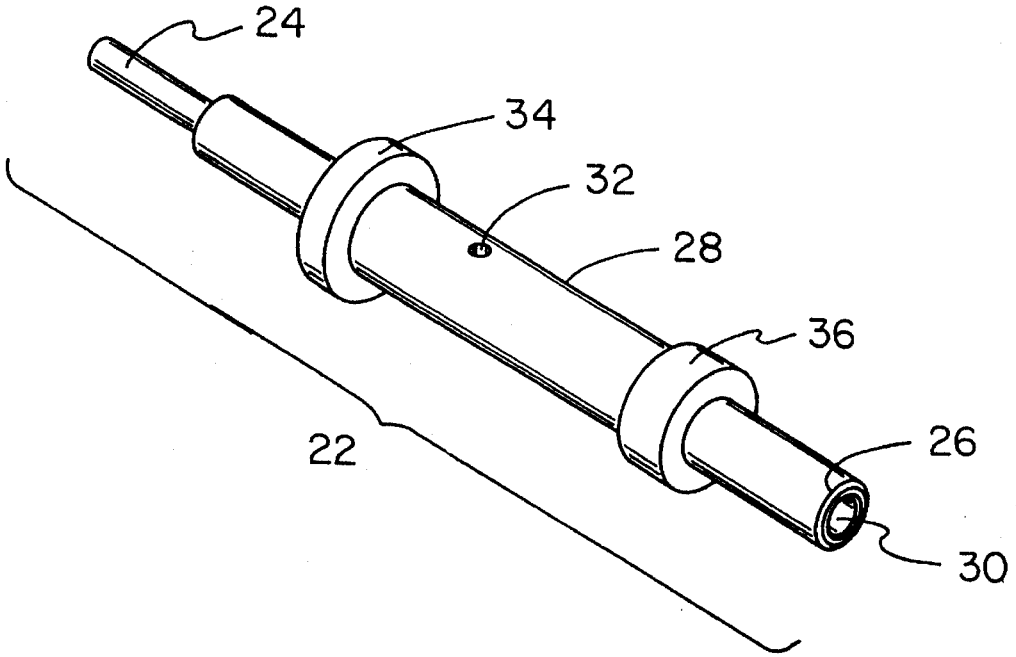
FIG. 6 is a perspective view of an inner stem of a terminal pin of the present invention.
Figure 7:
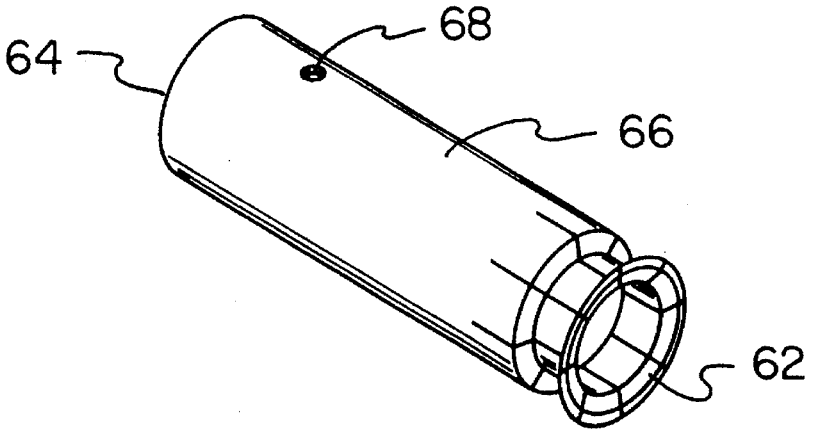
FIG. 7 is a perspective view of a sleeve of a terminal pin of the present invention.
Figure 8:
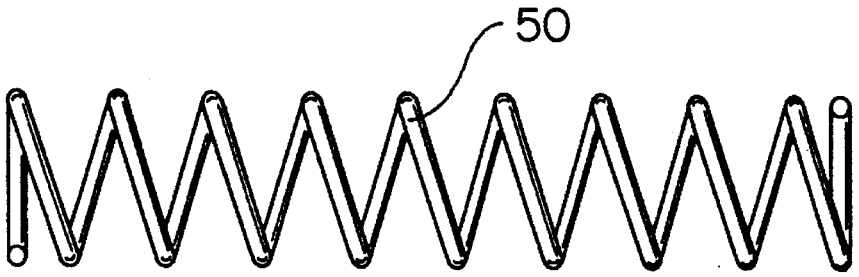
FIG. 8 is a side elevational view of a spring of a terminal pin of the present invention.

The second major component is the terminal pins 20. The present invention includes two pairs of terminal pins. The terminal pins are formed of a rigid metal and are electrically conductive. Each pair of terminal pins is extended through a separate base cap and coupled to the nearest electrode for transferring electrical current from an external power source thereto. Each terminal pin further has compressed orientation as shown in FIG. 2 and an uncompressed orientation as shown in FIG. 1. Each terminal pin essentially includes four subcomponents. The subcomponents are the inner stem, outer stem, spring, and sleeve. These subcomponents are interrelated to perform the intended function.

The first subcomponent of a terminal pin is the inner stem 22. The inner stem is elongated and rigid in structure. It has a proximal end 24, a distal end 26, and an intermediate portion 28 therebetween. The inner stem also includes an axial bore 30 disposed through the distal end and terminated at a location within the intermediate portion. The inner stem includes a vent hole 32 disposed through the intermediate portion and in communication with the bore. The vent hole provides aeration to the bore for allowing possible condensation build-up therein to be evacuated, thereby preventing corrosion that inhibits electrical conduction. The inner stem has a first collar 34 formed thereon between the vent hole and proximal end. The inner stem also has a second collar 36 formed thereon between the vent hole and distal end thereof. The first collar is secured within the base cap to ensure that the pin cannot be inadvertently removed therefrom through pushing or pulling forces applied thereto. The second collar serves as a support for enabling compression and extension of the pin.

The second subcomponent of the terminal pin is the outer stem 40. The outer stem is elongated and rigid in structure. The outer stem has a proximal end disposed within the bore 30 of the inner stem for slidable movement therein. The outer stem also includes a distal end 42 projected from the bore. The distal end has a head 44 formed thereon. The head serves as a support for enabling compression and extension of the pin.

The third subcomponent of the terminal pin is the spring 50. The spring is disposed about the inner stem 22 and the outer stem 40 between the second collar 36 and the head 44. The spring is used for urging the outer stem away from the inner stem to the uncompressed orientation.

The fourth subcomponent of the terminal pin is the sleeve 60. The sleeve has an open slotted proximal end 62, an open distal end 64, and an intermediate portion 66 therebetween. The sleeve also includes a vent hole 68 formed through the intermediate portion. The vent hole provides aeration within the sleeve for allowing possible condensation build-up therein to be evacuated, thereby preventing corrosion that inhibits electrical conduction and the movement of the outer stem with respect to the inner stem. The sleeve is disposed about the outer stem 40, spring 50, and inner stem 22. The proximal end of the sleeve is disposed about the inner stem to encompass the second collar. The slotted proximal end allows ready coupling of the sleeve with the inner stem. The proximal end is slidably moveable upon the inner stem between the second collar and base cap. The open distal end of the sleeve is secured about the outer stem to encompass a portion of the head. Therefore, in this configuration, the sleeve is slidable upon the inner stem. The outer stem is retracted towards the inner stem in the compressed orientation when a plunging force is applied to the head of the outer stem. The outer stem is urged away from the inner stem through the spring to the uncompressed orientation when a plunging force is removed from the head of the outer stem. The ratio of the length of the terminal pin in an uncompressed orientation to the length of the tube including end caps is between about 0.0051–0.0053. Furthermore, the length of each terminal pin is compressed by about 10% to about 50% in the compressed orientation.

A fluorescent lamp contains a low pressure gas such as neon, sodium vapor, or mercury vapor that produces light (through not always visible light) when excited by an electric current. The ultraviolet light is converted into visible light by a coating of phosphors (fluorescent chemicals) on the inside of the tube. The fluorescent lamp is much more efficient than the ordinary tungsten-filament electric light bulb. It provides about four times as much light for the same amount of electricity. The glass tube of the fluorescent lamp is coated with phosphors and is filled with argon gas and a small amount of mercury vapor. The negative electrode filament, heated by the current, emits negatively charged particles. The electrons are attracted to the positively charged filament at the opposite end of the tube. When the alternating current changes polarity, the electrodes reverse roles and electrons travel from the second electrode to the first. The alternating current changes polarity about 50 times per second, and with each change electrons set off along the tube. Consequently, electrons are traveling rapidly both up and down the tube. On their journey some of the electrons collide with mercury atoms. Each collision causes one of the electrons that is orbiting in the outer shell of the mercury atom to jump from its orbit temporarily and then fall back. The mercury electron returns to its original orbit and releases energy from the collision. The energy is in the form of a shortwave radiation-ultraviolet light. The ultraviolet light causes the phosphors coating the inner surface of the tube to fluoresce. The tube thus gives out visible light along its entire length.

Fluorescent lamps have terminal pins for easier insertion and removal from luminaires. These fluorescent lamps have two terminal pins which project from each end. They snap into strong spring clips in the luminaire. Most luminaires hold from two to four fluorescent lamps and are located at ceiling level. This invention provides spring-loaded terminal pins for the four foot fluorescent lamp to make insertion and removal much easier.

By spring-loading the terminal pins on either end of a four foot fluorescent lamp, installation and removal thereof can be done safely and in less time. Furthermore, no damage can be inflicted upon the associated fluorescent luminaire. In the prior art, the four foot fluorescent lamp has fixed terminal pins. In order to install the four foot fluorescent lamp in a commercial fluorescent luminaire such as a large-area ceiling unit, troffer, or conventional suspended or surface unit, one must literally scrape the paint off the inside metal of the luminaire during installation. Thus, while applying pressure to install the fluorescent lamp by hand, the fluorescent lamp may burst, thereby inflicting damage upon the luminaire or the installer. Due to the tight fit of the four foot fluorescent lamp, a lot of time is needed to install the fluorescent lamp in a luminaire. The present invention spring-loads the terminal pins on the four foot fluorescent lamp, thus eliminating all installation and removal problems. Typically, the actual length of a four foot tube with ends caps is between approximately 47 inches to about 49 inches. The length of a terminal pin is about 0.25 inches. Thus, the ratio of the length of a terminal pin to the length of the tube with end caps is between about 0.0051 (0.25/49) to about 0.0053 (0.25/47). The terminal pins are designed to have a compressibility between about 10% to about 50% to perform their intended function.

To remove conventional fluorescent lamps, the tube is grasped with the fingers and pulled down to withdraw the terminal pins from the openings in the spring clips of a luminaire which both hold the pins in place and act as contacts. The force required is often sufficient to shatter the thin glass tubing that encases the elements and gases. In practice, the length of the fluorescent lamp usually nearly matches the lamp insertion space of the luminaire, thereby adding to the difficulty in removal and insertion. By spring-loading the terminal pins, they can be pushed in so the other end of the lamp can slip into the spring clips more readily. Thousands of four foot fluorescent lamps are used in many office buildings, presenting a headache to a maintenance group when they must be changed. If a four foot fluorescent lamp failure happens during working hours, replacing this fluorescent lamp is very disruptive to people working in the area. The present invention will insert more readily in luminaries and will be much less likely to break during installation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A fluorescent lamp comprising:

(a) a tube having an inner surface and an outer surface and first and second ends;

(b) a first base cap mounted to said first end;

(c) a second base cap mounted to said second end;

(d) a first terminal pin moveably mounted to said first base cap, said first terminal pin comprising an inner stem member secured to said first base cap, an outer stem member slidably engaged with said inner stem, a spring member engaged with said inner stem member and said outer stem member, and a sleeve member surrounding said inner stem member, said outer stem, and said spring member; and (e) a second terminal pin moveably mounted to said second base cap.

* * * * *